US008523645B2

(12) United States Patent
Lee

(10) Patent No.: US 8,523,645 B2
(45) Date of Patent: Sep. 3, 2013

(54) GOLF CLUB HEAD AND HEAD COVER COMBINATION PROVIDING ENHANCED FUNCTIONALITY

(75) Inventor: David S. Lee, Wenham, MA (US)

(73) Assignee: Nike, Inc., Beaverton, OR (US)

( * ) Notice: Subject to any disclaimer, the term of this patent is extended or adjusted under 35 U.S.C. 154(b) by 301 days.

(21) Appl. No.: 12/410,804

(22) Filed: Mar. 25, 2009

(65) Prior Publication Data

US 2010/0248852 A1 Sep. 30, 2010

(51) Int. Cl.
*A63F 9/24* (2006.01)

(52) U.S. Cl.
USPC ..... 463/3; 473/220; 473/223; 473/324; 273/317

(58) Field of Classification Search
USPC ..... 473/220, 223, 324; 219/210; 150/160; 273/317; 463/3
See application file for complete search history.

(56) References Cited

U.S. PATENT DOCUMENTS

| | | | | |
|---|---|---|---|---|
| 3,649,028 | A * | 3/1972 | Worrell | 473/220 |
| 4,096,087 | A * | 6/1978 | Bianchin et al. | 252/586 |
| 4,927,015 | A * | 5/1990 | Jones | 206/315.9 |
| 4,991,850 | A | 2/1991 | Wilhlem | |
| 6,118,376 | A | 9/2000 | Regester | |
| 6,603,457 | B1 | 8/2003 | Nakanishi | |
| 7,118,498 | B2 | 10/2006 | Meadows et al. | |
| 2005/0227791 | A1 * | 10/2005 | McCreary et al. | 473/407 |
| 2007/0155537 | A1 | 7/2007 | Morris et al. | |
| 2008/0185557 | A1 * | 8/2008 | Agrawal et al. | 252/301.35 |
| 2008/0254907 | A1 * | 10/2008 | Swartz et al. | 473/237 |
| 2009/0008008 | A1 * | 1/2009 | Kuo | 150/160 |
| 2009/0017933 | A1 | 1/2009 | Stites | |
| 2009/0017934 | A1 | 1/2009 | Stites | |
| 2009/0093361 | A1 * | 4/2009 | Sakatani et al. | 502/309 |
| 2010/0093458 | A1 * | 4/2010 | Davenport et al. | 473/223 |

FOREIGN PATENT DOCUMENTS

| | | | |
|---|---|---|---|
| CA | 2696881 | A1 | 3/2009 |
| GB | 2448382 | A | 10/2008 |
| JP | H2-118579 | | 9/1990 |
| JP | 2001-67025 | | 3/2001 |
| JP | 2007-117743 | A | 5/2007 |
| JP | 2008-289865 | | 12/2008 |
| WO | 9428982 | A1 | 12/1994 |
| WO | 2009014103 | A1 | 1/2009 |

OTHER PUBLICATIONS

International Search Report for PCT/US2010/024901 mailed Jun. 7, 2010.

Notice of Reasons for Rejection (and its English translation) issued May 29, 2013 for corresponding Japanese Patent Application No. 2012-502062.

* cited by examiner

*Primary Examiner* — Pierre E Elisca
(74) *Attorney, Agent, or Firm* — Banner & Witcoff, Ltd.

(57) ABSTRACT

A golf club head has structure for assisting a golfer, and a head cover has structure for supporting the golfer-assisting structure. In one aspect, the golfer-assisting structure provides a visual indicator, such as an alignment marker, a ball impact indicator, a temperature indicator, or the like. In another aspect, the golfer-assisting structure includes sensor(s) and/or other electronic components for measuring swing characteristics, course conditions, global position, or the like. The supporting structure may provide a source of energy, such as a power source, a light source, or a heat source. In some aspects, the supporting structure may include a processor for receiving data from the golfer-assisting structure, and may transmit data to a display on the head cover and/or to an external source.

8 Claims, 4 Drawing Sheets

GOLF CLUB HEAD AND HEAD COVER COMBINATION PROVIDING ENHANCED FUNCTIONALITY

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g. golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also is available on the market that promises to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Also, individual club head models may include multiple variations, such as variations in the loft angle, lie angle, offset features, weighting characteristics (e.g., draw biased club heads, fade biased club heads, neutrally weighted club heads, etc.). Club heads may be combined with a variety of different shafts, e.g. from different manufacturers; having different stiffnesses, flex points, kick points, or other flexion characteristics, etc.; made from different materials; etc.). Between the available variations in shafts and club heads, there are literally hundreds of different club head/shaft combinations available to the golfer.

Like other sports, accurate vision is very important in golf Vision is important for many golfing activities, particularly in properly aligning oneself for a golf shot and/or in reading golf greens. Despite recent technological advances in golf equipment, putting remains a difficult portion of the game for many golfers. Putting requires golfers to perform a number of independent tasks, consider information relating to a number of different variables, and then combine the results of these tasks and analyses into a physical golf stroke. More specifically, first, the golfer must "read" the green to determine the desired speed at which to propel the ball and the desired direction to propel the ball. These features are dependent on one another in that a given putt generally may be propelled at a variety of different speeds and in a variety of different directions. Certain combinations of speed and direction (particularly over sloped terrain, like most golf greens) will result in successfully putting the ball into the hole. For example, a putt hit in a first direction may miss the hole (by going "above" the hole or "below" the hole) at a first speed, but a putt propelled in the same direction at a different speed (or within a relatively narrow range of speeds) may go into the hole. Similarly, a putt may be hit within a range of different directions, provided the golfer properly adjusts the putt's speed for the specific direction hit. After reading the green (e.g., considering its "slope") and deciding on a line and speed, the golfer then must hit the ball with the putter in the desired direction at the desired speed. Deviations in any of these judgments or execution may lead to missed putts.

Many factors can cause a golfer to hit a putt in the wrong direction, even when the golfer correctly judges the direction that the putt should be hit. For example, after the golfer has determined the desired line of the putt, he or she typically changes position to address and then hit the ball. Golfers may lose track of the desired line and/or inadvertently misalign themselves as they transfer their body from the putt reading position to the putt address position.

Additionally, before or during the course of a swing, the putter head may twist or otherwise misalign thereby causing the putt to drift off the desired line. This problem can be exacerbated when the club head itself contains sources of visual distraction, such as shiny surfaces, sharp corners or edges, etc. For example, when these visual distractions catch a user's eye as the putter swings, it may cause the golfer's eye, head, or other part of the body to move at least slightly, which can adversely impact the speed and/or direction of putter movement. Moreover, these visual distractions can obscure visualization of the club head's alignment aid, another feature that can adversely impact putting direction.

Fatigue also can play a role in putting. Visual attention and concentration in activities over long periods of time where fatigue can play a role, such as golf, especially under the harsh, varied, and changing environmental light conditions encountered during golf, is more readily maintained when the detail of interest (e.g., the alignment aid) is the brightest (strongest visual signal) throughout the visual field. Distracting features of putter heads and putter motion, as described above, can cause even more problems as fatigue sets in over the course of the golfer's round.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention are directed to golf clubs and components thereof, such as golf club heads, and golf club head covers. Some aspects are directed to a golf club head and head cover combination in which the golf club head has means for assisting a golfer, and the head cover has means for supporting the golfer-assisting means. In one aspect, the golfer-assisting means provides a visual indicator, such as an alignment marker, a ball impact indicator, a temperature indicator, a tilt-sensor on a putter to determine the slope of the green, or the like. In other aspects, the golfer-assisting means includes sensor(s) and/or other electronic components for measuring course conditions, global position, stroke count, swing characteristics such as interpreted accelerometer data, swing speed, impact energy, or the like. The supporting means may provide a source of energy to the golfer-assisting means, such as a power source, a light source, or a heat source. In some aspects, the supporting means may include a processor for receiving data from the golfer-assisting means, and may transmit data to a display on the head cover and/or to an external source by wireless transmission or the like.

BRIEF DESCRIPTION OF THE DRAWINGS

A more complete understanding of the present invention and certain advantages thereof may be acquired by referring to the following detailed description in consideration with the accompanying drawings, in which:

FIGS. 1C and 1D show an example of an alignment aid.

Figure 1A:
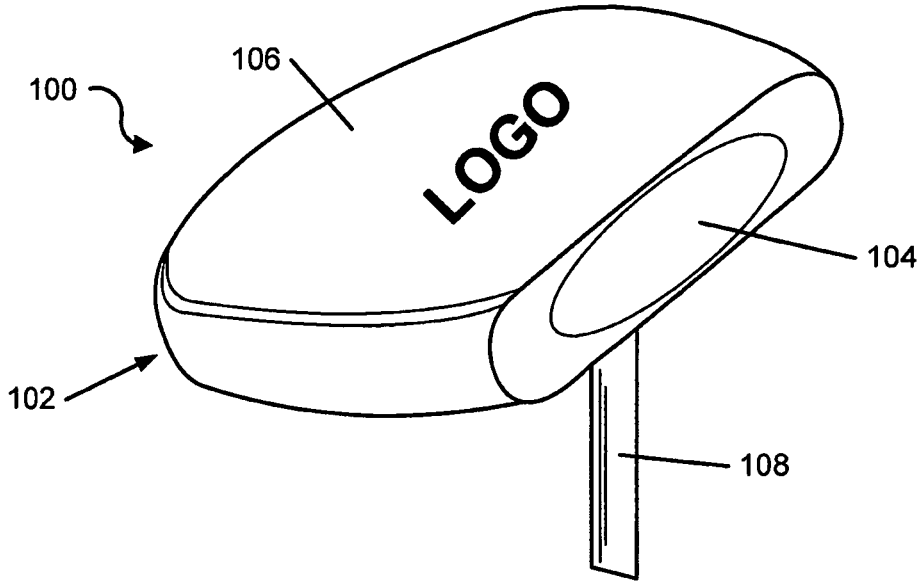
FIGS. 1A-1D illustrate an example of a golf club head.
Figure 1B:
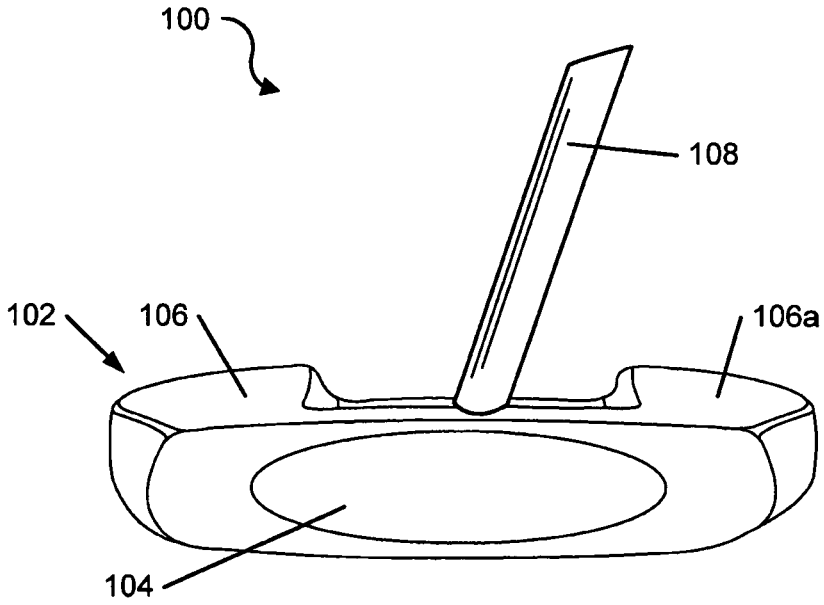

The reader is advised that the attached drawings are not necessarily drawn to scale.

DETAILED DESCRIPTION

In the following description of various example structures, reference is made to the accompanying drawings, which form a part hereof, and in which are shown by way of illustration various example golf club structures. Additionally, it is to be understood that other specific arrangements of parts and structures may be utilized and structural and functional modifications may be made without departing from the scope of the present invention. Also, while terms such as "top," "bottom," "front," "back," "rear," "side," "underside," "overhead," and the like may be used in this specification to describe various example features and elements of the invention, these terms are used herein as a matter of convenience, e.g. based on the example orientations shown in the figures and/or the orientations in typical use. Nothing in this specification should be construed as requiring a specific three dimensional or spatial orientation of structures.

A. General Description of Golf Clubs and Club Heads

FIGS. 1A-1D illustrate an example of a golf club structure which is a putter 100. A putter is shown for illustrative purposes only, as the features described herein may be used in combination with any type of golf club, non-limiting examples of which include drivers, fairway woods, fairway metals, hybrid clubs, irons, wedges, and the like. The illustrated putter 100 has a club head member 102 that has a ball striking face 104 attached to or integrally formed as part of a club head body 106. A shaft member 108 is engaged with the club head member 102 in any desired manner, such as via cements or adhesives; via threaded or other mechanical connectors; via welding, brazing soldering, or other fusing techniques; etc. The shaft member 108 and/or club head 102 may be made from any desired number of parts and/or any desired materials, including from conventional parts, conventional materials, and in conventional constructions as are known and used in the art.

Figure 1C:
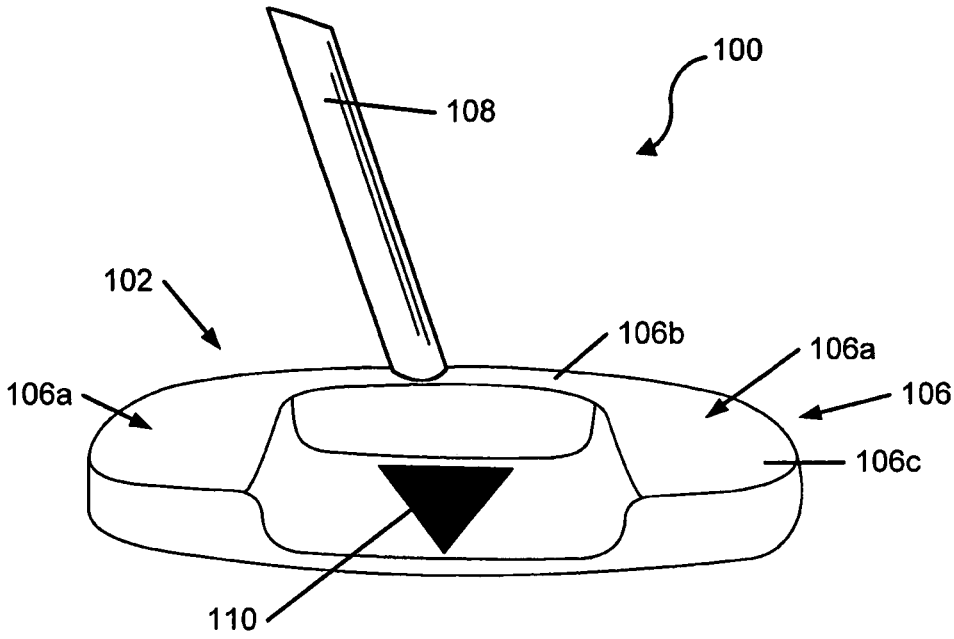
Figure 1D:
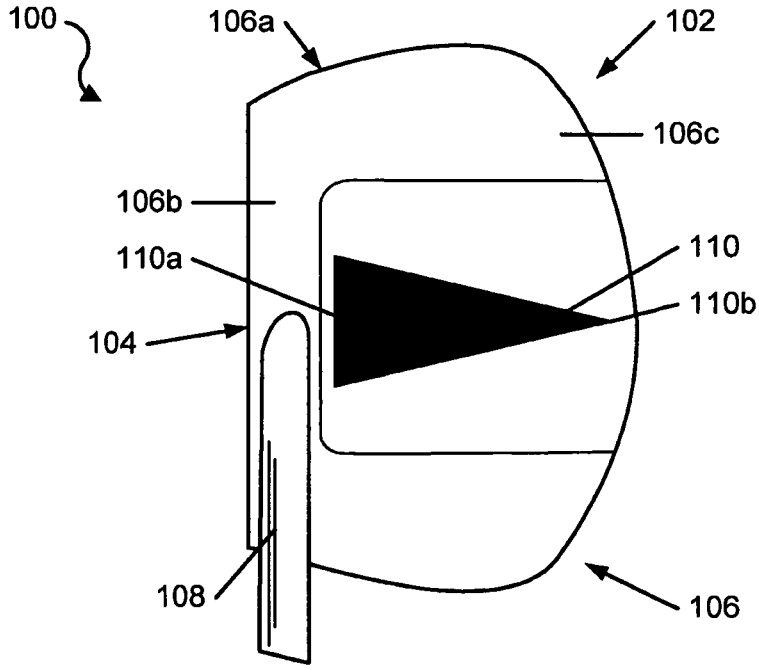

FIGS. 1C and 1D illustrate the top surface 106*a* of the club head body 106, particularly, the portion of the club head surface visible to a golfer when the club head 102 is placed at a ball address orientation in preparation to putt. The top surface 106*a* may be considered as including two primary portions, namely, the front or ball striking face portion 106*b* (e.g. that portion of the top surface 106*a* immediately adjacent to the ball striking face 104) and the rear or main body portion 106*c* (e.g. the portion of the top surface 106*a* extending from the ball striking face portion 106*b* and away from the ball striking face 104). The ball striking face portion 106*b* may be made from a different material and/or a different part from the main body portion 106*c* (and indeed it may be made from the same physical piece of material making up the ball striking face 104), or these various parts of the club head 102 may be integrally formed with one another as a unitary structure. There may or may not be clear lines of demarcation between the face 104, the ball striking face portion 106*b*, and/or the main body portion 106*c*.

The majority of the top surface 106*a* of the club head body 106 may have a non-reflective, matte type finish. The matte finish may be applied to the club head body 106 in any desired manner, such as by painting, by anodizing or other electroplating techniques, or the like. The dark color and matte finish help reduce the golfer's focus on the main body of the putter and help prevent light from reflecting off the putter head thereby causing a visual distraction as the golfer lines up and/or hits a putt. The term "matte finish," as used herein, is not intended to denote any specific finishing technique or method, but rather it is used generally to refer to any dull or drab finish and/or finishing technique. A matte finish is characterized as generally having reflectivity values below about 40 on a 20° reflectivity scale.

B. General Description of Golfer-Assisting Structure

In some aspects, a club head has structure for assisting a golfer by providing information relating to club head alignment, ball striking location, ambient conditions such as temperature, or the like. For example, a club head may have an alignment aid to assist a golfer in correctly aligning the club head when addressing a golf ball. As another example, the club head may have a ball impact indicator which provides a visual indication of the location on the club head at which a ball is struck. In other examples, the club head may have a temperature indicator, which may provide a colorimetric indication of ambient temperature. In general, the golfer-assisting structure may provide feedback to the golfer concerning swing characteristics, local course conditions, or some other information that may be beneficial to the golfer.

In some aspects, the golfer-assisting structure may include material(s) that are thermochromic, electrochromic, piezoelectric, or otherwise are responsive to the application of energy, e.g., mechanical energy such as force or sound, light, and/or current. Such materials may be coated onto or otherwise incorporated into a club head as described herein. Phosphorescent or other luminescent materials may be used, for example, to increase the visibility of an alignment aid, which may be particularly beneficial when the club is used under sub-optimal lighting conditions.

Materials that are thermochromic change color when exposed to different temperatures. Commercially available thermochromic inks, for example, offer a visible change in appearance when subjected to different temperatures. Within a range of temperature transitions, the inks remain a given color until a transition temperature is reached, at which point the color changes to another color. A region of the club head, such as a portion of the rear or main body portion 106*c*, may be coated with a thermochromic material to provide a colorimetric indication of ambient temperature. Optionally, a key member may be provided on the club head, head cover, or other suitable location to indicate the correspondence between the color of the thermochromic ink and a particular temperature range. Thermochromic materials may also be used to achieve other effects. For example, the entire club head or region(s) thereof may be coated with a thermochromic material(s) so that the color(s) of the club head changes according to the ambient temperature.

Electrochromic materials reversibly change color when a burst of charge is applied. An example of an electrochromic material is polyaniline, which can be formed either by the electrochemical or chemical oxidation of aniline. Depending on its reduction/oxidation state, polyaniline can either be pale yellow or dark green/black. Other non-limiting examples of electrochromic materials include viologens, polyoxotungstates, and tungsten oxide ($WO_3$). A portion of the club head, such as the rear or main body portion 106*c*, alignment aid 110, or other portion may be coated with an electrochromic material. An electrochromic material may be coated on alignment aid 110, for example, to increase its visibility. Alternatively, an electrochromic material having a color that highly contrasts with the color of the alignment aid 110 may be coated on the main body portion 106*c* to help increase the visibility of the alignment aid 110.

Piezoelectric materials generate an electric potential in response to applied mechanical stress. This may take the form of a separation of electrical charge across the crystal lattice. If the material is not short-circuited, the applied charge induces a voltage across the material. Piezoelectric materials may be used, for example, to indicate the impact location of ball on the club face. The mechanical stress resulting from ball impact (and resulting electric potential) may temporarily discolor the club face at the point of ball impact, providing the golfer with a visual indication of the ball's impact location. This information may be used by the golfer and/or a golf instructor, e.g., to make any necessary swing corrections.

In other aspects, the golfer-assisting structure may include one or more sensors and/or other electronic components for measuring swing characteristics, course conditions, global position, or the like. For example, one or more sensors may be embedded in or otherwise attached to a club head for measuring swing characteristics. Accelerometer data from the sensor(s) may be transmitted to a processor and/or to an external device, as discussed more fully below. Other non-limiting examples of electronic components include sensors for measuring course conditions such as temperature, humidity, barometric pressure, wind speed and/or direction, and so on. The sensor(s) may be equipped with global positioning capabilities, which may be used in combination with other electronic devices to assist a golfer in determining the distance to a target and/or to provide positioning information to another device or to third parties. For example, a sensor located on a driver could be used to transmit information to a starter or other clubhouse personnel regarding the time at which a particular golfer hit his or her tee shot on a particular hole, which could help in managing the pace of play. In the training or broadcast context, for example, a variety of types of information may be transmitted to third parties, including swing characteristics such as club head speed, swing plane, and the like.

C. General Description of Supporting Structure

In some aspects, a supporting structure is provided in association with a head cover. In some examples, the head cover is a pliable sleeve that covers the entire golf club head. However, the term "head cover," as used herein, is not so limited. A head cover may fit over (or be placed in close proximity to) only a portion of the club head. For example, a head cover may be a small hard or soft piece containing a LED light source and adapted to fit over the crown to charge phosphors contained therein. Depending on the type of golf-assisting structure used, the supporting structure may serve one or more of a variety of functions, such as providing a source of energy, e.g., a power source, a light source, and/or a heat source, and/or may receive, process, transmit, and/or display information relating to data received from the golfer-assisting structure.

When the club head contains a thermochromic coating, for example, the supporting structure may include a heat source. The heat source may be used to provide a uniform "starting" temperature for the thermochromic coating. This way, the portion of the club head containing the thermochromic coating will exhibit the same color each time the head cover is removed from the club head. For example, a club head may initially exhibit a neutral color when the thermochromic coating is at the temperature of the heat source, and thereafter may turn blue in colder temperatures, red in warmer temperatures, and so on.

When the club head contains phosphors, e.g., to improve the visibility of an alignment aid or the like, the supporting structure may include a light source to energize the phosphors. For example, a source of LED illumination may be provided inside a head cover to energize phosphors on the golf club head to make them glow more brightly.

A variety of types of energy sources may be incorporated into the head cover to provide energy needed for the functionality of the golfer-assisting structure as previously described. For example, an inside surface of a head cover may contain a suitable capacitor to power circuitry in the club head when the head cover is placed on the club head. For example, a capacitor positioned in the head cover may have suitable electrodes that contact electrodes on the club head (or metal portions of the club head that function as electrodes) when the club head is inserted into the head cover in a predetermined orientation. A variety of golfer-assisting structures, including electronic circuitry, LED lights, and sensors embedded in a golf club head, may utilize a power source such as a capacitor. The head cover may also include a rechargeable energy source (e.g., solar cell or the like) instead of or in addition to another energy source.

When the golfer-assisting structure includes a piezoelectric material, the supporting structure may include a power source for energizing the piezoelectric material. As described previously, piezoelectric materials generate an electric potential in response to applied mechanical stress. The piezoelectric effect is reversible, meaning that materials exhibiting a direct piezoelectric effect also exhibit the converse piezoelectric effect, namely the production of stress and/or strain when an electric field is applied. When a club face containing a piezoelectric material strikes a golf ball, for example, the face may exhibit markings or discoloration at the point of impact as described previously. When the piezoelectric material contacts a power source located inside a head cover, for example, the electric field may cause the piezoelectric material to exhibit stresses that act to reverse (remove) the markings or discoloration on the club face caused by striking the golf ball.

In another aspect, a head cover may provide memory storage capabilities or further circuitry for data gathering and/or data processing, such as for wireless transmission of data to other electronic devices. For example, accelerometer data obtained from sensors embedded or otherwise attached to the club head may be downloaded to electronics incorporated into the head cover. The head cover may be provided with sufficient analysis capabilities to analyze data taken on a previous swing and, through a head cover-mounted display (e.g., small liquid crystal display (LCD) or organic light emitting diode (OLED) screen), provide feedback or suggested changes to the player for subsequent swings. This type of information also could be transmitted to external devices for training or other analysis purposes.

D. Specific Examples of the Invention

One example of a club head is illustrated in FIGS. 1C and 1D. The golfer-assisting structure includes a visual indicator in the form of an alignment aid 110 on the top surface 106*a* of the club head 102. In some aspects, the alignment aid 110 may be made in a highly contrasting color (e.g. a luminous or fluorescent type color that greatly reflects light). While the alignment aid 110 may be in any desired color, it may be beneficial to select a color that highly contrasts with the remainder of the top surface 106*a* of the club head body 106.

The alignment aid 110 may be provided on or formed with the club head 102 in any desired manner. For example, the alignment aid 110 may be painted on or otherwise applied to or integrally formed as part of the club head structure 102. As another example, the alignment aid 110 may be a separate element (e.g., a metal plate, a plastic plate, etc.) that fits into a recess or is otherwise attached to the club head 102, e.g., using mechanical connectors; cements or adhesives; fusing techniques; etc. If desired, the alignment aid 110 may be made removable so that it can be replaced by another, e.g. of different size, shape, design, color, etc. The alignment aid 110 may include, for example, a thermochromic or electrochromic material.

Figure 2:
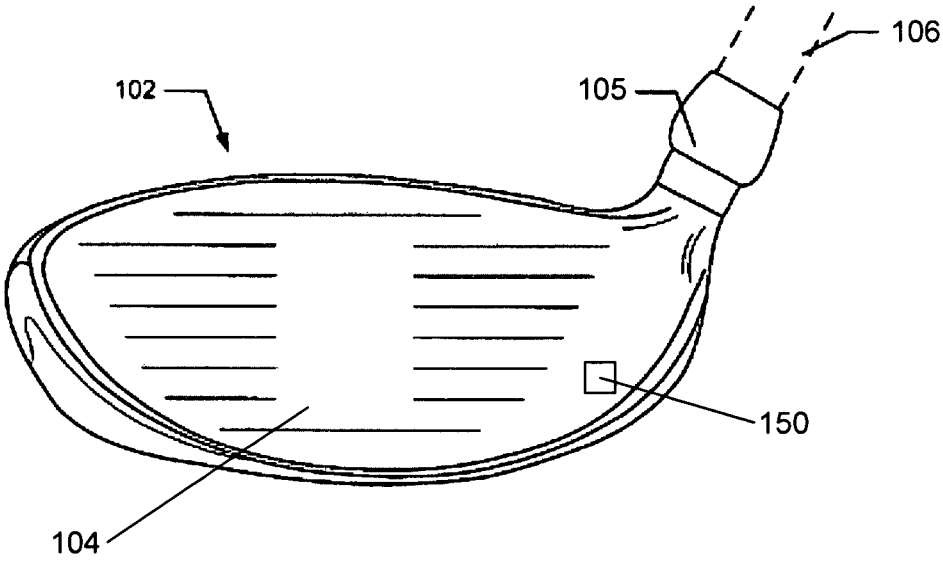
FIG. 2 illustrates an example of a club head having a sensor embedded in the face.

Another example of a club head containing golfer-assisting structure is illustrated in FIG. 2, which shows a club 100 having a club head 102 and a releasable club head/shaft connection region 105 that connects the club head 102 to a shaft 106. While a driver/wood-type golf club head 102 is illustrated in FIG. 2, the features may be used in with any type of clubs, such as wedges, hybrid clubs, putters, and the like. The club head 102 has a face 104 into which one or more sensors 150 are embedded. A sensor 150 is shown in FIG. 2 as being embedded into the face 104 for illustrative purposes only. It should be understood that the sensor(s) 150 may be provided on the top surface, bottom surface, or any other suitable location on (or within) the club head 102. The sensor 150 may be configured to measure accelerometer data or other swing characteristics (e.g., swing plane) when a golfer swings the club head 102, e.g., during play or practice.

Figure 3:
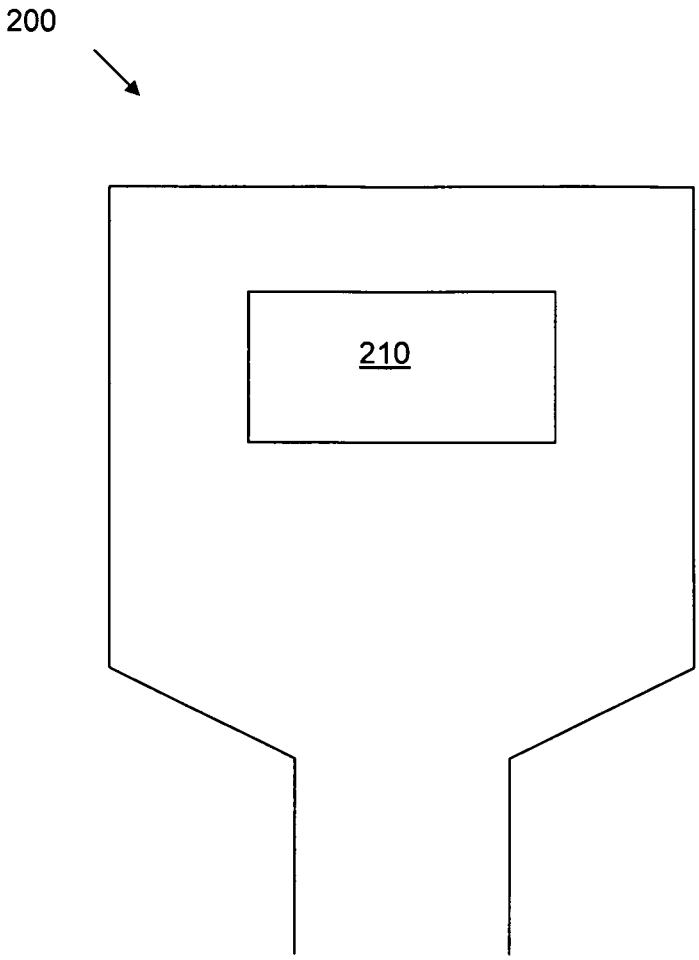
FIG. 3 schematically illustrates a club head cover having a supporting structure thereon.

FIG. 3 schematically illustrates an example of a head cover 200 containing supporting structure 210. When used in connection with the club head illustrated in FIG. 1, for example, the supporting structure 210 may be a LED light source located on an inside surface of the head cover for energizing a phosphor present on the alignment aid 110, or a heat source for activating a thermochromic coating present on the club head. When used in connection with the club head illustrated in FIG. 2, for example, the supporting structure 210 may be a capacitor located on an inside surface of the head cover for supplying energy to the sensor 150, or a display located on an outside surface of the head cover for displaying information relating to swing characteristics or other data received from the sensor 150.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A golf club head and head cover combination, wherein at least a portion of the golf club head is coated with an electrochromic material, and wherein the head cover comprises a source of current having electrodes, wherein the source of current is adapted to energize the electrochromic material to a cause a predetermined color change in the electrochromic material when the electrodes contact the golf club head.

2. The combination of claim 1, wherein the golf club head further comprises one or more sensors for measuring one or more golf swing characteristics.

3. The combination of claim 2, wherein the head cover further comprises a processor for analyzing data received from the one or more sensors.

4. The combination of claim 2, wherein the head cover further comprises a display for providing information relating to the one or more golf swing characteristics.

5. The combination of claim 4, wherein the display is a liquid crystal display (LCD).

6. The combination of claim 4, wherein the display is an organic light emitting diode (OLED).

7. The combination of claim 2, wherein the head cover further comprises circuitry for wireless data transmission to one or more external devices.

8. A golf club head and head cover combination, wherein at least a portion of the golf club head comprises a piezoelectric material adapted to form markings or discolorations upon impact with a golf ball, and wherein the head cover comprises a power source having electrodes, wherein the power source is adapted to provide an electric field for removing said markings or discolorations when the electrodes contact the golf club head.

* * * * *